US005139394A

United States Patent [19]

Aikawa et al.

[11] Patent Number: 5,139,394

[45] Date of Patent: Aug. 18, 1992

[54] AXIAL FLOW COMPRESSOR WITH INSERTABLE BEARING MOUNT

[75] Inventors: Eiichi Aikawa, Yokohama; Takayoshi Fujiwara, Kawasaki; Hisanori Honma; Yoshinori Sone, both of Yokohama; Takuya Hirayama, Fujisawa, all of Japan

[73] Assignee: Kabushiki Kaisha Toshiba, Kawasaki, Japan

[21] Appl. No.: 683,823

[22] Filed: Apr. 11, 1991

[30] Foreign Application Priority Data

Apr. 13, 1990 [JP] Japan ..... 2-96307
May 14, 1990 [JP] Japan ..... 2-121183

[51] Int. Cl.[5] ..... F04B 39/00

[52] U.S. Cl. ..... 417/356; 417/423.12; 417/423.14; 418/220; 384/441

[58] Field of Search ..... 417/356, 423.11, 423.12, 417/423.14; 384/440, 441

[56] References Cited

U.S. PATENT DOCUMENTS 2,718,193 9/1955 Zimsky ..... 417/423.12
4,573,882 3/1986 Watanabe et al. ..... 417/423.12
4,871,304 10/1989 Iida et al. .
4,872,820 10/1989 Iida et al. .
4,875,842 10/1989 Iida et al. .

*Primary Examiner*—Richard A. Bertsch
*Assistant Examiner*—David W. Scheuermann
*Attorney, Agent, or Firm*—Cushman, Darby & Cushman

[57] ABSTRACT

A compressor has a cylindrical casing unit having at least one open end. A compression element includes a circular cylinder held in the casing unit, a cylindrical rotating body having at least one spiral groove on its outer periphery and eccentrically arranged in the cylinder, and a spiral blade wrapped on the rotating body and fitted in the spiral groove in a manenr to be freely displaceable relative to the spiral groove. The cylinder and rotating body are journaled in a bearing means. A frame includes a cylindrical section intimately inserted into an open end of the casing unit and a disc section blocking the cylindrical section and provided orthogonal to an axis of the cylindrical section, the frame blocking the open end of the casing unit and supporting the bearing means. An electrically operating element has a stator fixed to an inner wall of the casing unit and rotor fixed to an outer periphery of the cylinder with a motor air gap defined relative to the stator, the electrically operating element rotationally driving the compression element to allow a relative rotation to be made between the cylinder and the rotating unit.

11 Claims, 5 Drawing Sheets

AXIAL FLOW COMPRESSOR WITH INSERTABLE BEARING MOUNT

BACKGROUND OF THE INVENTION

1. Field of the Invention

The present invention relates to an axial flow fluid compressor and, in particular, a compressor for compressing, for example, a refrigerant in a refrigerating cycle.

2. Description of the Related Art

Conventionally, various types of compressors are known, such as a reciprocating type and rotary type. In these compressors, a driving section includes a crank shaft, etc., for transmitting a rotational force and a compression section for receiving the rotational force from the driving section to perform a compressing operation. However, many associated parts are involved in the compressor, resulting in a complex compressor.

Further, a check valve is required on the discharge side to enhance a compression efficiency, but because of a very great pressure difference created across both sides of the check valve a gas is liable to leak out of the valve and the compression efficiency is lowered. In order to overcome such a problem, high accuracy is required for the associated parts and upon assembly. A greater cost is also involved in the manufacture of the compressor.

Recently, proposals have been made to provide an axial flow fluid compressor (U.S. Pat. Nos. 4,871,304; 4,872,802; 4,875,842, etc.). The fluid compressor can achieve sealing with a relatively simple arrangement, an effective compression and a ready manufacture and assembly of associated parts.

This type of fluid compressor (hereinafter referred to as a compressor) 101 is as shown in FIG. 5.

In the compressor 101, an electrically operating element 102 and compression element 103 are held in place in a closed casing. The electrically operating element 102 includes an annular stator 105 and annular rotor 106 provided inside the stator 105. The compression element 103 includes a cylinder 107 with the rotor 106 coaxially mounted on the outer periphery of the cylinder 107. The cylinder 107 is rotatably supported by a main bearing 108 at one end and the main bearing 108 is fixed to the closed casing 104 by a frame 109 jointed by a means, such as welding, to the inner surface of the closed casing 104.

A rotating rod 110 of cylindrical shape is held in the cylinder 107 in an axial direction. The center axis A of the rotating rod 110 is located eccentric with the center axis B of the cylinder 107. The rod 110 is rotatably supported by the bearings 108 and 111 at both ends. In FIG. 5, e represents an amount of eccentricity.

A spiral groove 112 is provided on the outer periphery of the rotating rod 110 with its pitch gradually varied. A spiral blade 113 is fitted in the groove 112. Respective portions of the blade 113 are displaceable relative to the groove 112 and the outer periphery of the blade 113 is slidable on the inner wall of the cylinder 107 in intimate contact state.

A plurality of working chambers 114 are formed between the inner wall of the cylinder 107 and the outer periphery of the rotating rod 110. The respective working chamber 114 is defined as a substantially crescent spacing extending from an area of contact of the rotating rod 110 with the inner wall of the cylinder 107 to the next area of contact. The working chambers 114, . . . are gradually decreased in their capacity from a suction side to a discharge side of the cylinder 107.

Upon the turning ON of the electrically operating element 102, the rotor 106 is rotated, causing the compression element to be rotationally driven. The cylinder 107, together with the rotor 106, is rotated as one unit and the rotational force of the cylinder 107 is transmitted through a rotational force transmission mechanism 115 to the rotating rod 110. The cylinder 107 and rod 110 are, while being displaced relative to each other, rotated in a synchronous way.

A working fluid, such as a gaseous refrigerant, is sucked into the cylinder 107 and carried past the respective working chambers 114, . . . sequentially. The working fluid is gradually compressed in a route from the suction side to the discharged side of the cylinder 107.

In this type of compressor, a narrow, uniform spacing, that is a motor air gap 116, is formed between the stator 105 and the rotor 106. Since the cylinder 107 is journaled in the main bearing 108 at the one end and the main bearing 108 is supported on the frame 108, it is necessary to provide exact perpendicularity to a seat surface 117 of the frame 109.

However, as the frame 109 is fixed to the closed casing 104 by the means, such as welding, no adequate perpendicularity is imparted to the seat surface 117 of the frame 109 if the frame 109 is simply mounted on the closed casing 104. It is, therefore, necessary to finish-shape the seat surface 117 of the frame 109 by machinery after it has been mounted in place in the compressor, and to enhance the aforementioned perpendicularity. This finish-shaping operation has to be done in the closed casing 2 and hence is complex and time-consuming.

SUMMARY OF THE INVENTION

It is accordingly the object of the present invention to provide an axial flow fluid compressor which can be readily assembled with a uniform gap defined between a stator and a rotor constitute an electrically operating element.

According to the present invention, there is provided a compressor comprising:

a cylindrical casing unit having at least one open end;

a compression element including a circular cylinder held in the casing unit, a cylindrical rotating body having at least one spiral groove on its outer periphery and eccentrically arranged in the cylinder and, a spiral blade wrapped on the rotating body and fitted in the spiral groove in a manner to be freely displaceable relative to the spiral groove;

a bearing means in which the cylinder and rotating body are journaled;

a frame including a cylindrical section intimately inserted into an open end of the casing unit and a disc section blocking the cylindrical section and provided orthogonal to an axis of the cylindrical section, the frame blocking the open end of the casing unit and supporting the bearing means; and an electrically operating element including a stator fixed to an inner wall of the casing unit and rotor fixed to an outer periphery of the cylinder with a motor air gap defined relative to the stator, the electrically operating element rotationally driving the compression element to allow a relative rotation to be made between the cylinder and the rotating unit.

DETAILED DESCRIPTION OF THE PREFERRED EMBODIMENTS

The present invention will be explained below with reference to FIGS. 1 to 3.

Figure 1:
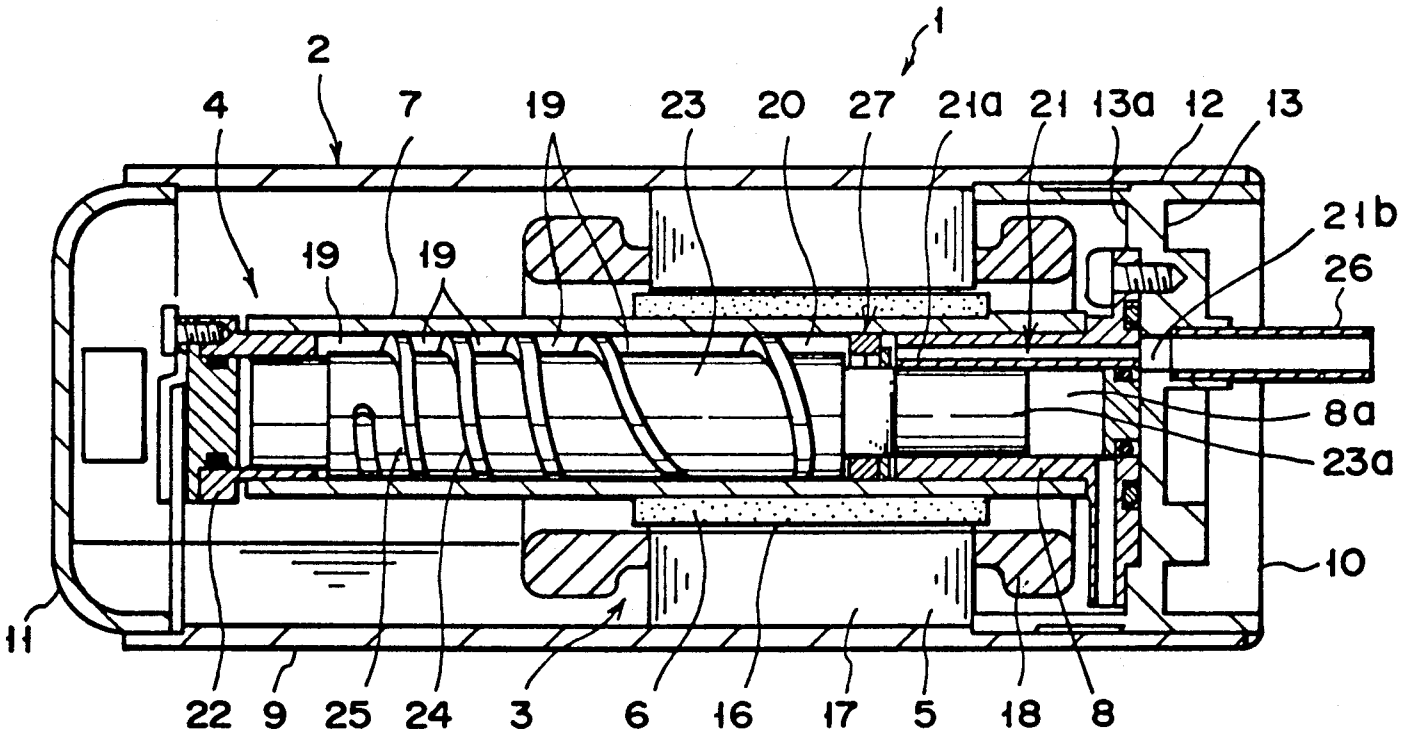
FIG. 1 is a cross-sectional view showing an axial flow fluid compressor according to a first embodiment of the present invention.

FIG. 1 shows a first embodiment of the present invention. In FIG. 1, reference numeral 1 shows a closed type axial flow fluid compressor (hereinafter referred to as a compressor) for compressing a refrigerant, for example, in a refrigerating cycle.

The compressor 1 holds an electrically operating element 3 and compression element 4 in a closed casing 2.

The electrically operating element 3 includes an annular stator 5 fixed to the inner surface of the closed casing 2 and annular rotor 6 provided inside the stator 5.

The compression element 4 includes a hollow cylinder 7 and the rotor 6 is coaxially inserted over the outer periphery of the cylinder 7. The cylinder 7 is rotatably journaled in a main bearing (bearing means) 8 at one end.

The closed casing 2 comprises a cylindrical casing unit 9 opened at at least one end and frame 10 for closing the open end of the casing unit 9. A bottom member is provided integral with the frame unit 9 or, in an alternative, a separate covering 11 is provided to cover the other end of the casing unit 9. The stator 5 constituting one element of the electrically operating element 3 is fitted in the casing unit 9. The rotor 6 constituting the other element of the electrically operating element 3 is fitted over the cylinder 7.

In the present embodiment, the casing unit 9 is hermetically sealed by the frame 10 at one end and by the covering 11 at the other end. The frame 10 is located on a suction side, that is on the right side, of the casing unit 9 and the covering 11 is located on a discharge side, that is on the left side, of the casing unit 9 in FIG. 1.

The frame 10 comprises a cylindrical section 12 intimately fitted in the opened end portion of the casing unit 9 and a disc section 13 provided integral with the cylindrical section 12 and closing the open end of the cylindrical section 12 at an intermediate area of the cylindrical section 12.

Figure 2:
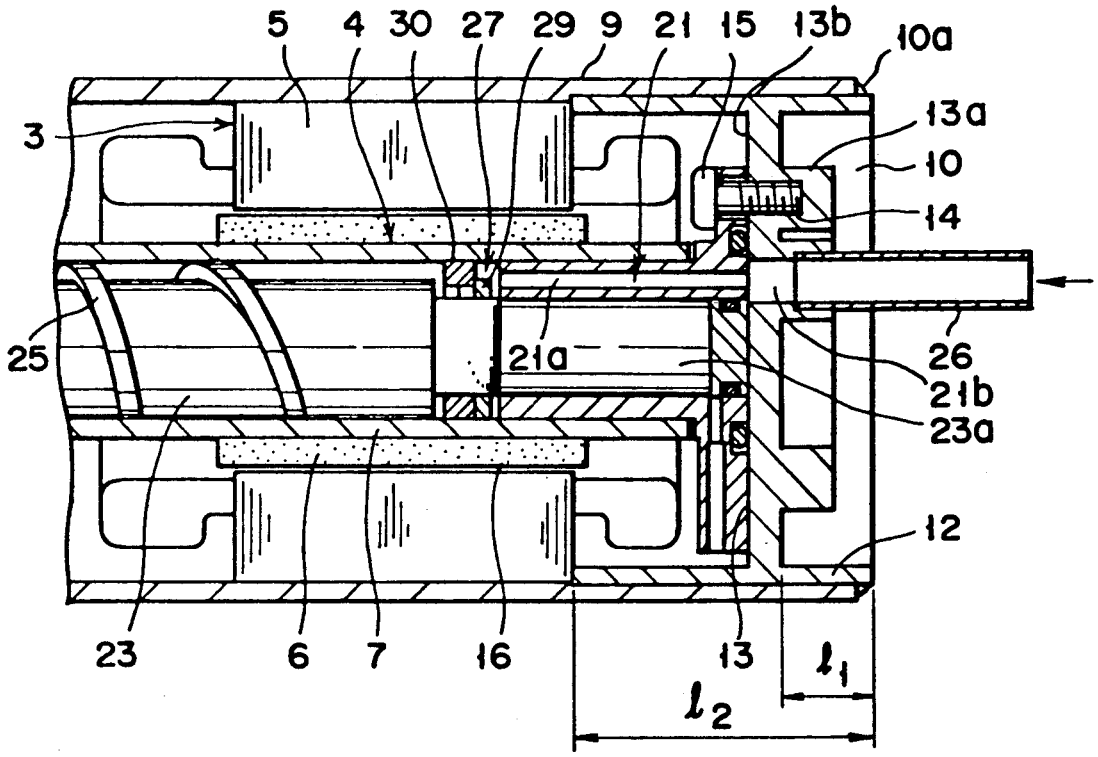
FIG. 2 is an enlarged view showing part of the compressor in FIG. 1.

Stated in more detail, with the full length of the cylindrical section 12 of the frame 10 defined by l2, the disc section 13 is located at a distance l1 from the end of the cylindrical section 12 as shown in FIG. 2, noting that $l2>l1$. The cylindrical section 12 and disc section 13 have their thickness set to be large enough to maintain adequate rigidity. The perpendicularity of the axis of the cylindrical section 12 (and casing unit 9) to the seat surface 13*b* of the disc section 13 is so set as to ensure high accuracy.

The cylindrical section 12 is intimately inserted in the casing unit 9 with its end portion somewhat projected from the end of the casing unit 9. Welding is effected along the end edges of the casing unit 9 and frame unit 10.

At this time, high heat energy is conducted from a welding spot 10*a* to the frame 10, but the disc section 1 is not thermally affected because adequate thickness is ensured at the cylindrical section 12 and disc section 13 of the frame 10 and because of the distance l1 spaced from the welding spot 12, that is from the end edge of the cylindrical section 12. The cylindrical section 12 is inserted into the casing unit 9 substantially over a full length (l2) and hence no loose fit is produced at the frame 10.

As a result, exact perpendicularity is ensured between the axis of the cylindrical section and the seat surface 13*b* of the disc section 13*b* in an as-manufactured state.

The disc section 13 is made thicker at the control area than at the other area to provide a central thickened area 13*a*. Further, a plurality of screw holes 14 are provided at the thickened section 13*a* of the disc section and opened at the seat surface 13*b* of the disc section 13. The main bearing 8 is securely mounted by mount screws 15 on the disc section 13.

That is, the main bearing 8 supports the suction end side of the cylinder 7 and the rotor 6, constituting one element of the electrically operating element, is inserted over the cylinder 7. The main bearing 8 is connected to the thickened section 13*a* of the disc section 13 and provided in a direction orthogonal to the axis of the cylindrical section 12. The axis of the main bearing 8 and cylinder 7 parallel to the axis of the cylindrical section 12 are set to be quite exactly orthogonal to the seat surface 13*b* of the disc section 13.

As a result, the rotor 6 fitted over the cylinder 7 and stator 5 fitted into the casing unit 9 are positioned opposite to each other over their full length to define a uniform spacing, that is a uniform motor air gap 16, therebetween over their full length.

The electrically operating element 3 is comprised of a DC brushless motor which includes the stator 5 for generating a magnetic field upon flow of a current in a winding 18 turned on an iron core 17 and magnetic type annular rotor 6 comprised of a permanent magnet. The electrically operating element 3 is located at an area shifted to the suction side of the closed casing 2 and the stator 5 is fixed to the inner wall of the casing unit 9.

The rotor 6 is located inside the stator 5 with the aforementioned uniform motor air gap 16 defined relative to the iron core 17 over its full length. The rotor 6 is fitted over the outer periphery of the cylinder 7 such that it is fixed concentric with, and as one unit together with the cylinder 7.

The rotor 6 is positioned at an area shifted to the suction end side of the cylinder 5 and at an area outside of a suction chamber 20 located as one (suction chamber) of working chambers 19, . . . as will be set out below, that is as one chamber nearest to the suction side, and outside of a suction passage 21 provided in the main bearing 8. The rotor 6 is rotated under a magnetic force generated relative to the stator 5 upon the supply of power to the stator 5 and is rotated as one unit together with the cylinder 7.

The compression element 4 includes a cylinder 7 held in the closed casing 2 with their axial ends hermetically sealed by the main bearing 8 and auxiliary bearing 22 and made of an iron-based magnetic material. The cylinder 7 has its thickness uniformly formed over its full length.

In the spacing of the cylinder 7 is held a rotating rod 23 which is provided as a cylindrical rotating body along its axial direction. The rotating rod 23 is arranged eccentric with the cylinder 7 and the portions of the outer periphery of the rotating rod 23 are in contact with the inner wall of the cylinder 7. Both ends of the rotating rod 23 are rotatably supported by the main and auxiliary bearings 8 and 22.

A spiral groove 24 is provided on the outer periphery of the rotating rod 23 with its pitch gradually varying from the suction side to the discharge side of the cylinder 7, that is from a right side to a left side of the cylinder 7 as shown in FIG. 1.

The spiral blade 25 is fitted in the spiral groove 24 and made of, for example, a fluorine resin material and hence has a proper elasticity with its thickness substantially corresponding to the width of the groove 24. The respective portions of the blade 25 can be displaced in a radial direction of the rod 23 relative to the groove 24. The blade 25 can be slidably moved with its outer periphery placed in intimate contact with the inner wall surface of the cylinder 7.

The outer periphery of the rotating rod 23 and inner wall of the cylinder 7 provide a plurality of working chambers 19, . . . defined by the spiral blade 25. The respective working chamber 19 has a substantially crescent spacing along the adjacent blades from an area of contact of the rod 23 with the inner wall of the cylinder 7 to an adjacent corresponding area of contact similarly defined. The working chambers 19 are gradually decreased in their capacity from the suction side to the discharge side of the cylinder 7.

The main bearing 8 and frame 10 have their through holes 21*a* and 21*b* communicating with each other. The suction passage 21 is defined by both the through holes 21*a* and 21*b* and extends through the main bearing 8 and frame 10. The suction passage 21 extends in a direction substantially parallel to the axis of the cylinder 7 and has its inner end opened into the cylinder 7. The through hole 21*b* of the frame 10 is greater in passage area than the through hole 21*b* of the main bearing 8.

A suction tube 26 extends through the frame 10 such that it is externally connected to the frame 10 and hence to the thickened section 13*a* of the disc section 13 to allow it to communicate with the suction passage 21.

The cylinder 7 has its discharge hole, not shown, at an area near to the auxiliary bearing 22. The discharge hole of the cylinder 7 is located on the discharge side of the cylinder 7. A discharge tube is connected to the closed casing 2 and communicates with the discharge hole via an internal spacing of the closed casing 2.

The compression element 4 is fixed to the frame 10 through the main bearing 8. The compression element 4 enables the axis of the cylinder 7 to substantially align with that of the closed casing 2 and is oriented in a direction substantially perpendicular to the seat surface 13*b* of the disc section 13.

The cylinder 7 is rotationally driven by the electrically operating element 3 and the rotational force of the cylinder 7 is transmitted by a rotational force transmission mechanism 27 to the rod 23.

Figure 3:
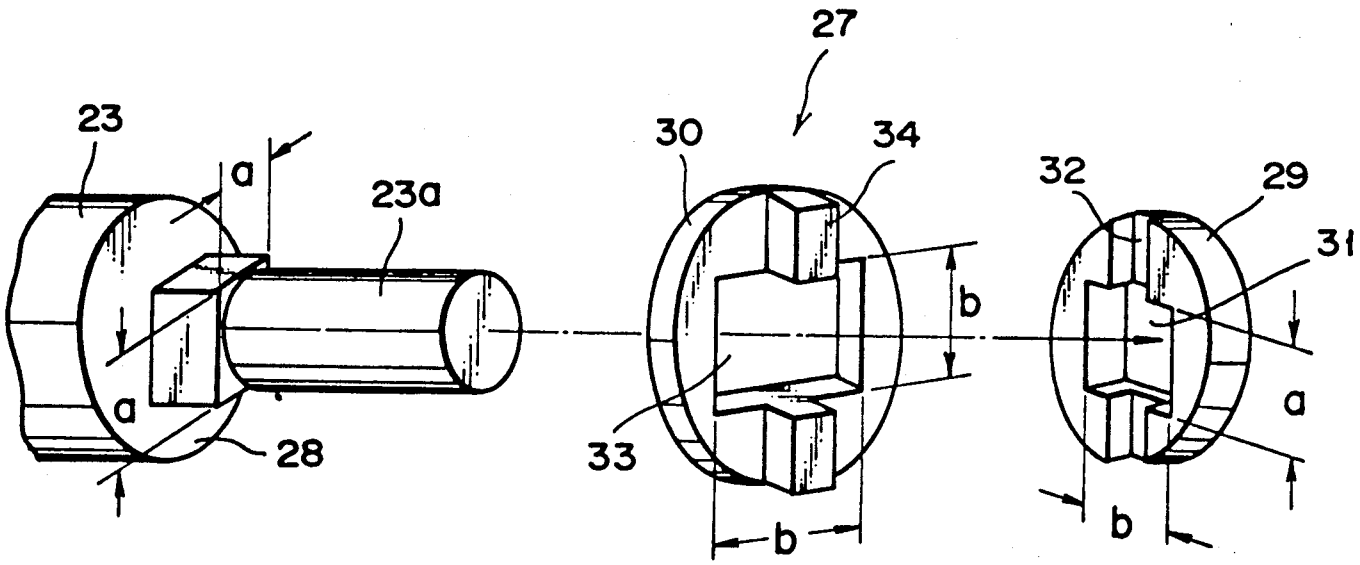
FIG. 3 is an exploded, perspective view showing a rotational force transmission mechanism of the compressor in FIG. 1.

That is, the transmission mechanism 27 comprises, as shown in FIGS. 1 to 3, a rectangular section 28 provided integral with a main shaft section 23*a* of the rotating rod 23, Oldham ring 29 and Oldham ring receiving member 30. Upon rotation of the cylinder 7, the rotational force transmission mechanism 27 transmits a rotational force to the rod 23, allowing the cylinder 7 and rod 23 to be rotated synchronously while being displaced relative to each other.

The rotational force transmission mechanism 27 and its surrounding will be explained in more detail below.

The rotating rod 23 has the main shaft section 23*a* at one end. The main shaft 23*a* is journaled in a support hole 8*a* of the main bearing 8 with the rectangular section 28 provided as a rectangular parallelepiped integral with a base end side of the main shaft section. The cross-sectional shape of the rectangular section 28 is of an a×a dimension type.

The Oldham ring 29 is made up of a disc plate of proper thickness and has a diameter substantially equal to that of the rod 23. A rectangular latching hole 31 is provided at the central area of the Oldham ring 29 and has a vertical dimension a and lateral dimension b greater than the vertical dimension a.

An Oldham ring groove 32 is provided across the Oldham ring 29 past the hole 31 and extends in a vertical direction, that is in a direction perpendicular to that in which the rectangular section 28 is latched to the rectangular latching hole 31.

The Oldham ring receiving member 30 is of a disc-like type and is fixedly fitted into the cylinder 7. A guide opening 33 b×b in dimension is opened at the central area of the Oldham ring receiving member 30. A pair of opposed projections 34 are provided across the receiving member 30 with the guide opening 33 therebetween. The projection 34 is slidably latched to the Oldham ring groove 32 of the Oldham ring 29.

When the rotational force transmission section 27 is to be assembled, the projection 34 of the Oldham ring receiving member 30 is latched to the Oldham ring groove 32 of the Oldham ring 29. The Oldham ring 29 and Oldham ring receiving member 30 are inserted, at the latching hole 31 and guide opening 33, over the main shaft section 23*a* of the rod 23 to enable the Oldham ring 29 and Oldham ring receiving member 30 to latchingly engage with the rectangular section 28. Upon insertion of the rod 23 into the cylinder 7, the Oldham ring receiving member 30 is fixed to a predetermined area of the cylinder 7.

The operation of the compressor 1 will be explained below.

Upon rotation of the rotor 6 following the conduction of the electrically operating element 3, the cylinder 7 is concentrically rotated, together with the rotor 6, as one unit. The rotational force of the cylinder 7 is transmitted to the rod 23 through the rotational force transmission mechanism 27. The rod 23 is rotationally driven in an eccentric way while its outer periphery is being in contact with the internal wall surface of the cylinder 7. The cylinder 7 and rod 23 are rotated synchronously while they are being displaced relative to each other.

The blade 25 is rotated, together with the rod 23, as one unit while its outer peripheral surface is in contact with the inner wall surface of the cylinder 7. As the portions of the blade 25 approach an area of contact of the outer peripheral surface of the rod with the inner wall surface of the cylinder, they enter the spiral groove 24. The blade portions emerge from the groove 24 as they are displaced from the aforementioned groove 24.

With the compression element 4 operated, a refrigerant is drawn into the suction chamber 20 through the suction tube 26 connected to the frame 10 and then through the suction passage 21 extending past the frame 10 and main bearing 8. The gaseous refrigerant thus drawn is sequentially supplied to the successive working chambers 15 in a direction toward the discharge side, while the rod 23 is being rotated, and compressed in a manner to be confined in the working chamber 19.

The compressed refrigerant is once discharged from the discharge hole provided near the auxiliary bearing 22 and into an internal spacing of the closed casing and returned back in the refrigerating cycle via the discharge tube.

A low-pressure refrigerant prior to being compressed and somewhat pressure-raised refrigerant are guided into the inside of the rotor 6 (and cylinder 7) and blocked by the rotor 6 against a high-pressure gaseous refrigerant discharged into the outside of the cylinder 7.

That is, since the rotor 6 is located at the suction side of the cylinder 7 to block the low-pressure gas against the high temperature/high pressure gas outside the cylinder 7, better blocking is provided between the suction gas and the discharge gas, that is, those gases having a greater temperature difference.

It is thus possible to prevent heating of the suction gas and hence to maintain the temperature of the refrigerant. It is also possible to prevent an increase in relative capacity. A loss in refrigeration capability resulting from a temperature rise of the refrigerant is not involved. The compressor can operate at a maximum one of those inputs to the electrically operating element 3.

Since a temperature rise of the suction gas is prevented, an excessive temperature rise can be prevented at those component parts of the piston 23, blade 25, etc. It is, therefore, possible to stabilize clearances between the groove 24 of the rod 23 made of, for example, a metal and the blade 25 made of a synthetic resin and fitted in the groove 24 and to prevent their degradation resulting from a "creep" phenomenon and hence a decrease in their service life.

Further, the rotor 6 can be provided without forming steps relative to the cylinder 5 and the compressor 1 can be made compact as a whole.

The stator 5 is provided on the inner surface side of the closed casing 2 and, since any members made of nonmagnetic material, such as the closed casing 2, are not present between the stator 5 and the rotor 6, the motor air gap 16 can be formed as a smaller air gap between the stator 5 and the rotor 6, ensuring a better motor characteristic.

As the rotor 6 is not conducted in such a way that a rotor of, for example, an AC motor is done, the evolution of heat due to the carrying of a current in the rotor 6 is not involved in the present compressor 1. Therefore, the presence of the rotor 6 prevents heating of the refrigerant in the cylinder 5.

Figure 4:
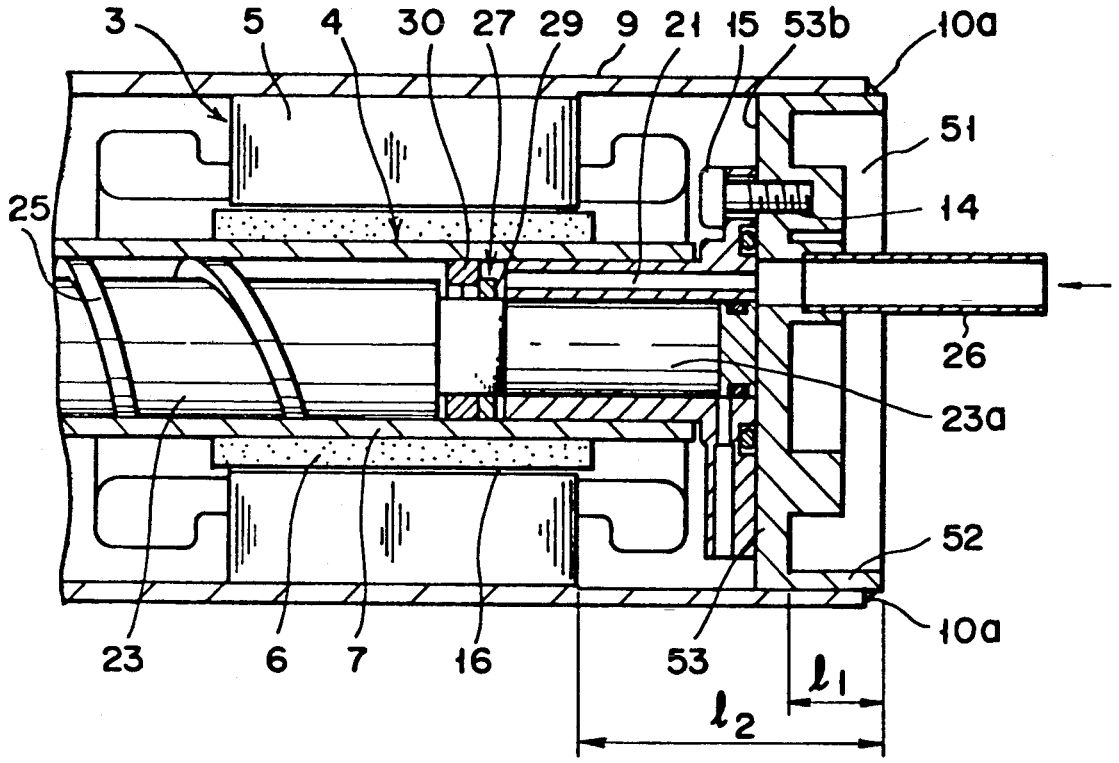
FIG. 4 is a cross-sectional view showing a major section of an axial flow fluid compressor according to a second embodiment of the present invention.
Figure 5:
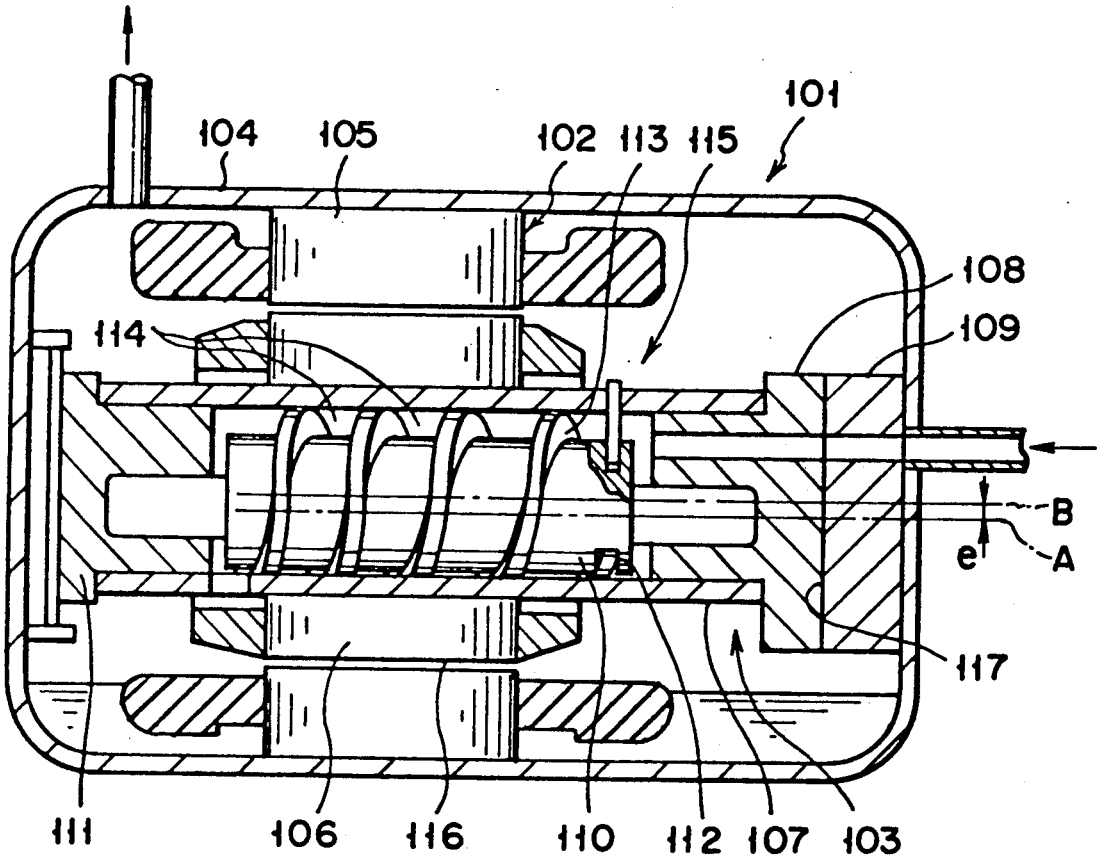
(PRIOR ART) FIG. 5
FIG. 5 is a cross-sectional view showing a conventional axial flow fluid compressor similar in its type to the compressor of the present invention in particular.

FIG. 4 shows a second embodiment of the present invention, like reference numerals being employed to designate like parts corresponding to those shown in the first embodiment.

In the embodiment shown in FIG. 4, a frame 51 is mounted on a casing unit 9 and comprises a cylindrical section 52 intimately inserted into the open end of the casing unit 9 and a disc section 53 provided integral with an intermediate section of the axial section of the cylindrical section 52 and closing the cylindrical section 52.

The disc section 53 is situated at one end of the axial section of the cylindrical section 52, that is, at an end remote from a welded spot 10*a*. A thickened section 53*a* is formed at the central area of the disc section 53 and a main bearing 8 is fixedly mounted by mount screws 15 on the thickened area 13*a* of the disc section 13. The degree of perpendicularity of the axis of the cylindrical section 12 (and casing unit 9) to a seat surface 53*b* of the disc section 53 is set with high accuracy.

The compressor of the present invention is not restricted in its application to the refrigerating cycle.

For example, the present invention can be also applied to an axial flow fluid compressor having two pair of a specific part including a spiral groove and spiral blade.

What is claimed is:

1. A compressor comprising:

a cylindrical casing unit having at least one open end;

a compression element including a circular cylinder held in the casing unit, a cylindrical rotating body having at least one spiral groove on its outer periphery and eccentrically arranged in the cylinder, and a spiral blade wrapped on the rotating body and fitted in the spiral groove in a manner to be freely displaceable relative to the spiral groove;

a bearing means in which the cylinder and rotating body are journaled;

a frame including a cylindrical section intimately inserted into an open end of the casing unit and a disc section blocking the cylindrical section and provided orthogonal to an axis of the cylindrical section, the frame blocking the open end of the casing unit and supporting the bearing means; and an electrically operating element including a stator fixed to an inner wall of the casing unit and rotor fixed to an outer periphery of the cylinder with a motor air gap defined relative to the stator, the electrically operating element rotationally driving the compression element to allow a relative rotation to be made between the cylinder and the rotating unit.

2. A compressor according to claim 1, wherein said frame is welded to the casing unit with the disc section provided at an area remote from that welded spot.

3. A compressor according to claim 2, wherein said cylindrical section of said frame is externally projected from the casing unit.

4. A compressor according to claim 3, wherein said disc section of said frame is provided as an intermediate section on an axial section of the cylindrical section of the frame.

5. A compressor according to claim 3, wherein said disc section of said frame is provided on the axial section of said cylindrical section of the frame at its end opposite to that at which the weld spot is present.

6. A compressor according to claim 4 or 5, wherein said casing unit is opened at both ends, one end being blocked by the frame and the other end being closed by a covering.

7. A compressor according to claim 1, wherein said cylindrical section of said frame has a thickened section on which said bearing means is mounted by screws.

8. A compressor according to claim 7, wherein said cylindrical section of said frame has a thickened section to which a suction tube is connected.

9. A compressor according to claim 1, wherein said electrically operating element is comprised of a DC brushless motor.

10. A compressor according to claim 1, wherein the cylinder is made of magnetic material and the rotor is provided on an outer periphery of the cylinder and made of a permanent magnet.

11. A compressor according to claim 10, wherein said cylinder has two axial ends, one end being provided as a suction side and the other end being provided as a discharge side, and the rotor being provided in a manner shifted toward the suction side of the cylinder.

* * * * *